US008371674B2

(12) United States Patent
Powers et al.

(10) Patent No.: US 8,371,674 B2
(45) Date of Patent: Feb. 12, 2013

(54) METHOD AND PRINTING SYSTEM FOR IMPLEMENTING JET DETECTION

(75) Inventors: Russell James Powers, Fairport, NY (US); Bryon Reo Young, Pittsford, NY (US); Alicia Schwenk Mruthyunjaya, Penfield, NY (US); Paul F. Brown, II, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 280 days.

(21) Appl. No.: 12/877,727

(22) Filed: Sep. 8, 2010

(65) Prior Publication Data

US 2012/0056928 A1 Mar. 8, 2012

(51) Int. Cl.
*B41J 29/393* (2006.01)

(52) U.S. Cl. ..... 347/19

(58) Field of Classification Search ..... 347/5, 9, 347/14, 19

See application file for complete search history.

(56) References Cited

U.S. PATENT DOCUMENTS 6,637,853 B1 * 10/2003 Ahne et al. ..... 347/19
7,427,118 B2 9/2008 Mizes et al.
2008/0062219 A1 3/2008 Mizes et al.
2008/0303854 A1 12/2008 Mizes et al.
2010/0020121 A1 1/2010 Mizes et al.

OTHER PUBLICATIONS

R. Enrique Viturro, U.S. Appl. No. 12/755,117, filed Apr. 6, 2010.
Cary Eric Sjolander, U.S. Appl. No. 12/419,665, filed Apr. 7, 2009.

* cited by examiner

*Primary Examiner* — An Do
(74) *Attorney, Agent, or Firm* — Pillsbury Winthrop Shaw Pittman, LLP

(57) ABSTRACT

Disclosed is a user interface associated with a printing system and a method of using the user interface to select a profile for jet detection. The printing system has a plurality of jets for outputting test images and document images and a jet detection device with at least one or more sensors for reading the output test images to detect faulty jets. The user interface provides a plurality of profiles for the jet detection device for selection. Each profile has a plurality of predetermined conditions that cause a test image to be printed at a particular location and analyzed. For example, a profile can include a time and a location for printing output test images using one or more of the plurality of jets. Thus, a user can control the conditions for outputting test images and determining missing or faulty jets within the system.

29 Claims, 8 Drawing Sheets

CYCLING UP

FIG. 4 CYCLING DOWN

FIG. 5 BETWEEN PRINT JOBS

FIG. 6 AFTER "X" PAGES

METHOD AND PRINTING SYSTEM FOR IMPLEMENTING JET DETECTION

BACKGROUND

1. Field of Invention

The present invention is generally related to any printing apparatus or system that can produce an output test pattern or image and monitor the output images to determine errors or faults.

2. Description of Related Art

In a continuous feed printing system, e.g., based on solid inkjet technology, multiple print heads are distributed over a long print zone to obtain desired color and image resolutions in an output document. Each print head may have one or more jets for outputting colorant such as ink onto a web 10. For example, as shown in FIG. 1, a continuous paper web 10 may be moved in a process direction P during printing. The web 10 may have an imageable area 14 (or print area) and images 12 of a document for output may be printed on the web 10 within the area 14. Because faulty jets can produce undesirable output images and/or delay processing time of a job, printing systems typically include detection devices for detecting faulty jets. For example, a sensor 20 may be provided adjacent the web 10 to read test patterns 16 that are printed by the jets within an inter-document zone (IDZ) region 18 between document images 12, as illustrated in FIG. 1. As known in the art, these test patterns 16 may be scanned or sensed in a cross process direction C using one or more sensors 20, such as a full width array (FWA) sensor or an image sensor. Based on the sensed test patterns the system can determine or detect faulty or missing jets.

In current systems, when missing jet detection is turned on, test patterns 16 are printed in the IDZ region 18 and the sensor(s) 20 scan test patterns 16 and provide feedback to the system if it is determined that any jets are not firing (or some other similar fault related to the jets). Typically, if a jet is deemed faulty, the system is designed to substitute neighboring jets to fire and replace the missing jet, and notifies the customer which jet(s) is(are) not firing. However, some customers will turn this detection feature off. For example, when a customer is not able to cut out or chip out test patterns using their existing finishing equipment capabilities (e.g., when the web 10 is cut for output), the customer may opt to stop the system from printing test patterns and thus sensing the same. However, if a system cannot print and read the test patterns, correction for faulty or missing jets will not be performed during print jobs, and, therefore, output image quality will be degraded (e.g., because the system will not know when jets do not fire or are intermittent). Generally, such problems may exist on any printing system that can produce a test pattern, scan or sense the test pattern, and compensate for image quality defects, because such detection may be turned off.

A method and system that offers a customer flexibility to adjust conditions related to printing and sensing (scanning) test patterns (e.g., when and where test patterns are printed and/or sensed) would improve customer satisfaction without hindering the image quality of printed documents.

SUMMARY

One aspect of the disclosure provides a method for selecting a profile for jet detection in a printing system. The printing system has a processor for processing documents containing image data, a plurality of jets for outputting test images and document images onto an imageable surface, and a jet detection device having at least one or more sensors for reading the output test images to detect faulty jets. The method includes:

providing a plurality of profiles for the jet detection device to a user interface associated with the printing system, each profile having at least a time and a location for printing output test images on the imageable surface using one or more of the plurality of jets and sensing using the at least one or more sensors;

receiving a selected profile of the plurality of profiles selected for jet detection;

determining at least the time and the location for printing output test images on the imageable surface, and implementing the selected profile for one or more print jobs of the printing system.

Another aspect of the disclosure provides a user interface associated with a printing system. The printing system has a processor for processing documents containing image data; a plurality of jets for outputting test images and document images onto an imageable surface; and a jet detection device having at least one or more sensors for reading the output test images to detect faulty jets. The user interface provides a plurality of profiles for the jet detection device, and each profile has at least a time and a location for printing output test images using one or more of the plurality of jets.

Other features and advantages of the present invention will become apparent from the following detailed description, the accompanying drawings, and the appended claims.

DETAILED DESCRIPTION OF THE PREFERRED EMBODIMENT(S)

Throughout this disclosure, "test images," also sometimes referred to as test patterns or patches, are defined as marks of color (e.g., ink) which are provided on an imageable surface such as a paper web (such as web 10 of FIG. 1) or other similar surface, and used to monitor features for printing documents. As shown throughout the FIGS., any number of test images may be used. Also, test images may be defined to a particular area on an imageable surface, and may cover a part of such area or the entire defined area. An "imageable surface" may be defined as a surface for receiving ink or colorant for outputting pages or documents. For example, as described throughout this disclosure, a continuous paper web is an imageable surface. Alternatively, although not discussed in detail herein, other imageable surfaces, such as a photoreceptor belt for receiving paper sheets, or non-continuous surfaces, such as individual paper sheets, may be an imageable surface used with the method and system described in this disclosure.

Figure 1:
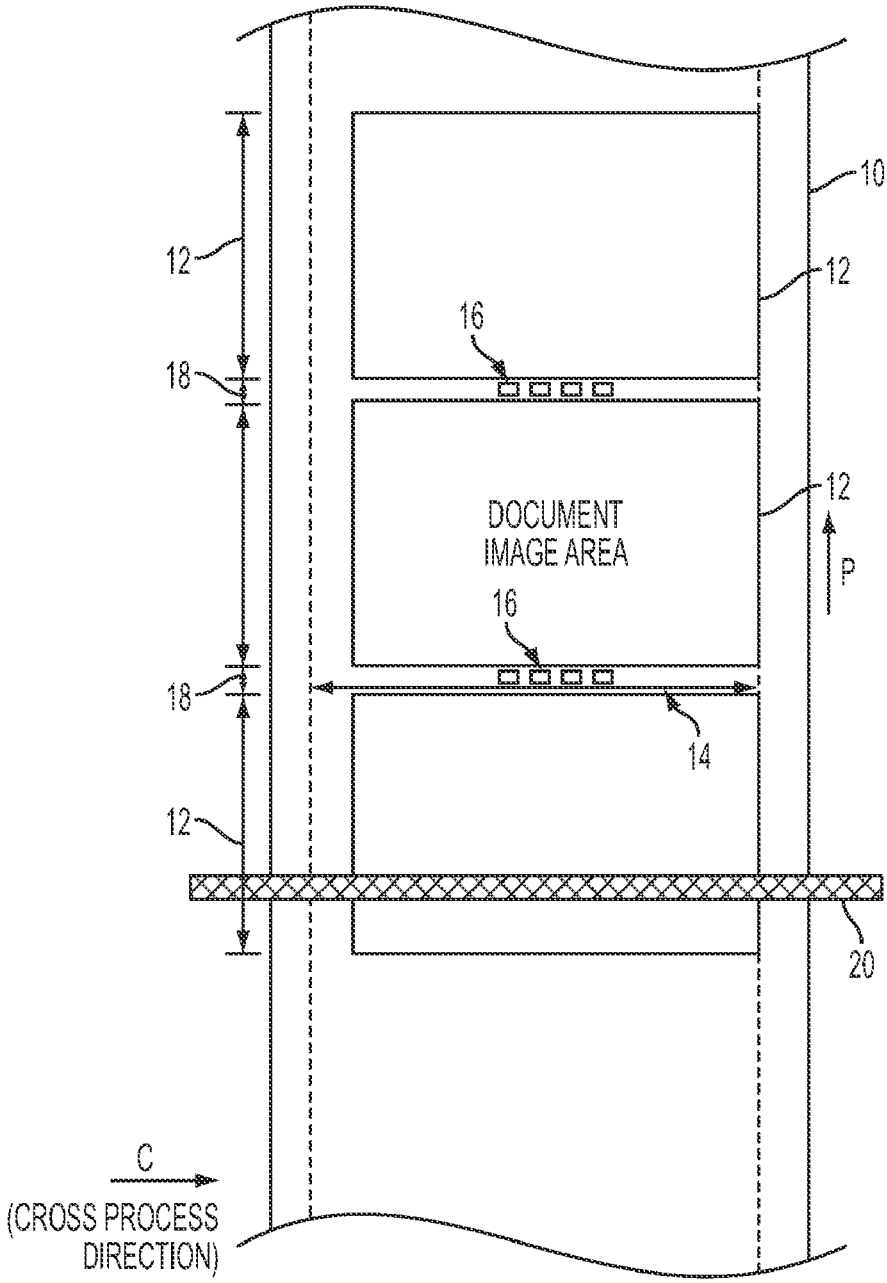
FIG. 1 illustrates a top plan view of a continuous paper web including document image areas and test images in inter-document zones in accordance with an embodiment of the disclosure.

Test images may be used to monitor an amount of ink or colorant on the web for each output color. Test images may be in the form of marks of a predetermined darkness value, a predetermined color blend, a desired density, or a particular shape, such as a line pattern; or they may be of a shape for determining registration of superimposed images (e.g., fiducial or registration marks). Test images of specific types may be placed on a paper web at specific or predetermined locations. For example, as shown in FIG. 1, a plurality of test images 16 may be placed in the IDZ 18 (while image data is placed in the document image area(s) 12 or 14). Such test images 16 may be made on continuous paper web 10 by one or more jets of print heads (such as jet nozzles 156 of print heads 152 in the system of FIG. 7, described below). The printing process of the test patches 16 may be controlled, for example, by a print controller 162 and/or processor 220. An exemplary continuous web printer system 100, which may implement the herein disclosed features, is further described below with reference to FIG. 7.

It is also noted that throughout this disclosure, the process direction is the direction in which the web, onto which the image is transferred and developed, moves through the image transfer and developing system. The cross-process direction, along the same plane as the web, is substantially perpendicular to the process direction. An "imageable area" is defined as an area used for printing at least a part of an image for output. An inter-document zone or IDZ is defined as one or more areas between imageable areas on the image bearing surface that are not used for raster output of a document/document images.

Although the herein described embodiments reference use with a (substantially) continuous paper web system, other apparatuses or systems that can produce an output test pattern or test image and monitor the output test images to determine errors or faults (e.g., with jets) may utilize the disclosed features.

Typically current printing systems with missing jet detection devices print and scan customer images (of a document) or test images such as images 16 (as shown in FIG. 1) placed on the paper by the system using pre-programmed or predetermined conditions, i.e., printing and scanning test images in the IDZ between document images during printing of page(s). However, current printing systems generally do not offer any flexibility to a user or customer as to the conditions (e.g., when and where) under which test images are printed and scanned. Sometimes these test images may be visible on a printed document. As noted above, because of this inflexibility, users tend to turn the detection feature off, which results in unacceptable process times and output images, for example.

This disclosure is designed to provide a user or customer with selectable choices or profiles related to when and where test images can be printed to enable missing jet detection by jet detection devices (sensors), instead of turning missing jet detection entirely off (or on). Throughout this disclosure, a "profile" is defined as a predetermined set of conditions causing a predetermined location of a test image to be printed and analyzed. For example, in an embodiment, a condition includes a time or period, e.g., a time in a machine cycle, such as during cycle-up, cycle-down, or between print jobs.

As will become apparent by the description below, this disclosure allows a user more choices as to a time (when) and a location (where) for implementing missing jet detection and printing of the necessary images. That is, the user is able to select parameters for a machine and thus enable parameterization for missing jet detection. Such choices can be implemented on the printing system without interrupting a print job and/or without placing non-job related images during printing of a job. Additional advantages will become more evident in the described below embodiments.

Figure 2:
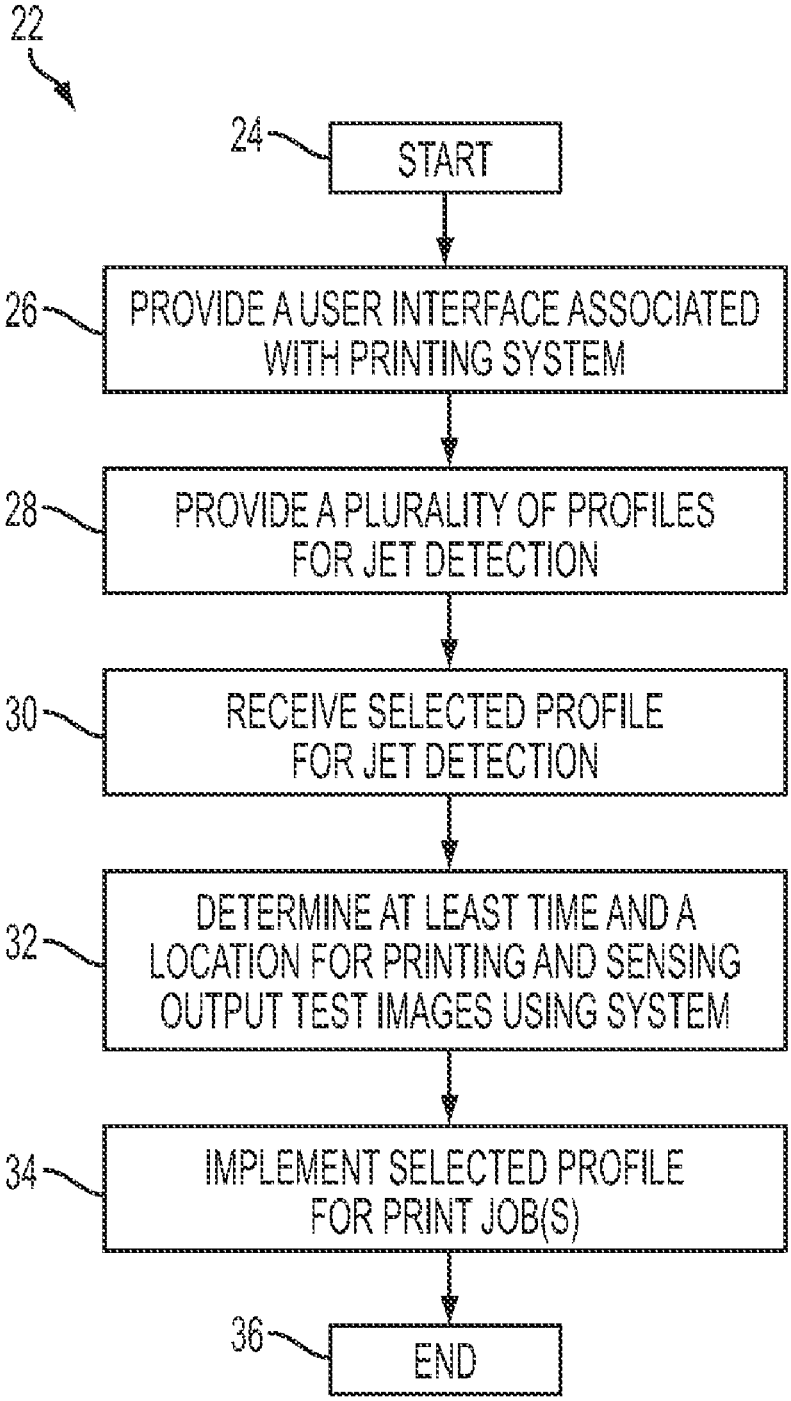
FIG. 2 illustrates a method for selecting a profile for jet detection in a printing system in accordance with an embodiment of the present disclosure.

FIG. 2 illustrates a method 22 for selecting a profile for jet detection in a printing system in accordance with an embodiment. The method 22 begins at 24 is designed to be implemented by a processor (or processors) or controller, such as described with reference to FIGS. 7 and 8. At 26, a user interface associated with the printing system is provided. At 28, a plurality of profiles for the jet detection device of the printing system is provided.

The herein described exemplary embodiments are based on a profile whose predetermined conditions are based on time. That is, each profile comprises at least a time-based condition and a location for printing output test images on the continuous paper web of the printing system using one or more of the plurality of jets or print heads. Throughout this disclosure, "time" is defined as a period or an interval for outputting or printing test images. For example, time-based condition may be: a time between outputting document images of the one or more print jobs onto the imageable surface; when the printing system cycles up to print the one or more print jobs; when the printing system cycles down after printing the one or more print jobs; when a fault in the printing system is detected; a time between outputting the one or more print jobs in a queue of the printing system; after a preselected number of pages in the one or more print jobs are output; after paper is loaded into the printing system, and when the printing system exits a standby mode. "Location" is defined as a place, a site, or a position on an image bearing surface for outputting or printing test images. For example, the location may be: within an inter-document zone between the document images on the imageable surface; on the imageable surface before the plurality of jets output the document images for the one or more print jobs; on the imageable surface after the plurality of jets output the document images for the one or more print jobs; on the imageable surface at a predetermined location at a time of a detected fault; on one or more blank test areas provided between the one or more print jobs; and on one or more blank test areas provided after a selected number of output document images or pages.

Referring back to FIG. 2, after the profiles are provided, the processor receives a selected profile for jet detection at 30. For example, a user may select a profile via the user interface from the plurality of profiles for one or more print jobs. Then, at least the time and the location (that are associated with the selected profile) for printing and sensing output test images are determined at 32. The processor then implements the selected profile for one or more print jobs at 34. For example, it may determine that the printing of output test images must be turned on or turned off (e.g., until test images should be printed). The method ends at 36.

Any number of profiles may be provided (e.g., via user interface) and are not limited. For example, the embodiments of profiles described below are exemplary and may be changed. In an embodiment, user may be presented with a single profile comprising both a time and a location. However, it is within the scope of this disclosure that times and locations for outputting and/or sensing test images may be provided as separate parameters (via the user interface).

Additionally and/or alternatively, additional parameters may be input and received by a processor. For example, a profile may include a user-specified threshold that is related to the printing jets. An example of such a threshold may be limiting which jets are fired to print test images and/or output images. For example, a user may wish to limit printing and analyzing of test images to a black only color selection, or black and one colorant (e.g., black and magenta). Alternatively, in an embodiment, a user may use the threshold selection as a predetermined condition for printing and analyzing test images in a predetermined location, e.g., if only black ink (or black and one colorant) is used for output during a job, then missing jet detection may be limited to black heads of the jets, so that test images could be printed and analyzed for that job (or, if two colors are selected, limit jet detection to those two colors and/or those specific jets).

In an embodiment, the selected profile may be implemented for a single print job. In an embodiment, after the print job is output, the processor and/or controller may revert to a default profile for any other print jobs (within a queue or received after completion of the print job). In another embodiment, a selected profile may be a configuration setting that is applied to a system or device that prints according to a selected profile until an alternate profile is selected. In yet another embodiment, the selected profile may be implemented for each print job associated with a particular user. For example, a user may select a profile for jet detection to be used for each print job that is to be output by the printing system. Nonetheless, such embodiments are not meant to be limiting.

In an embodiment, implementing a selected profile at 34 may include turning on or turning off sensing using a jet detection device upon selection of a particular profile. For example, depending on the time and location for printing test images (and sensing the same), the processor or controller may turn off printing and sensing test images until an appropriate time and location occurs in the process or job.

In an embodiment, the selected profile comprises a time being between document images of the one or more print jobs and a location being within an IDZ region. In this embodiment, for example, the printing system may fire a few of the jets within each print head to output test images. Such a profile is shown in FIG. 1, for example. Test images 16 may be printed in the IDZ 18 between document images 12 and one or more sensors 18 are used to sense the images 16.

Figure 3:
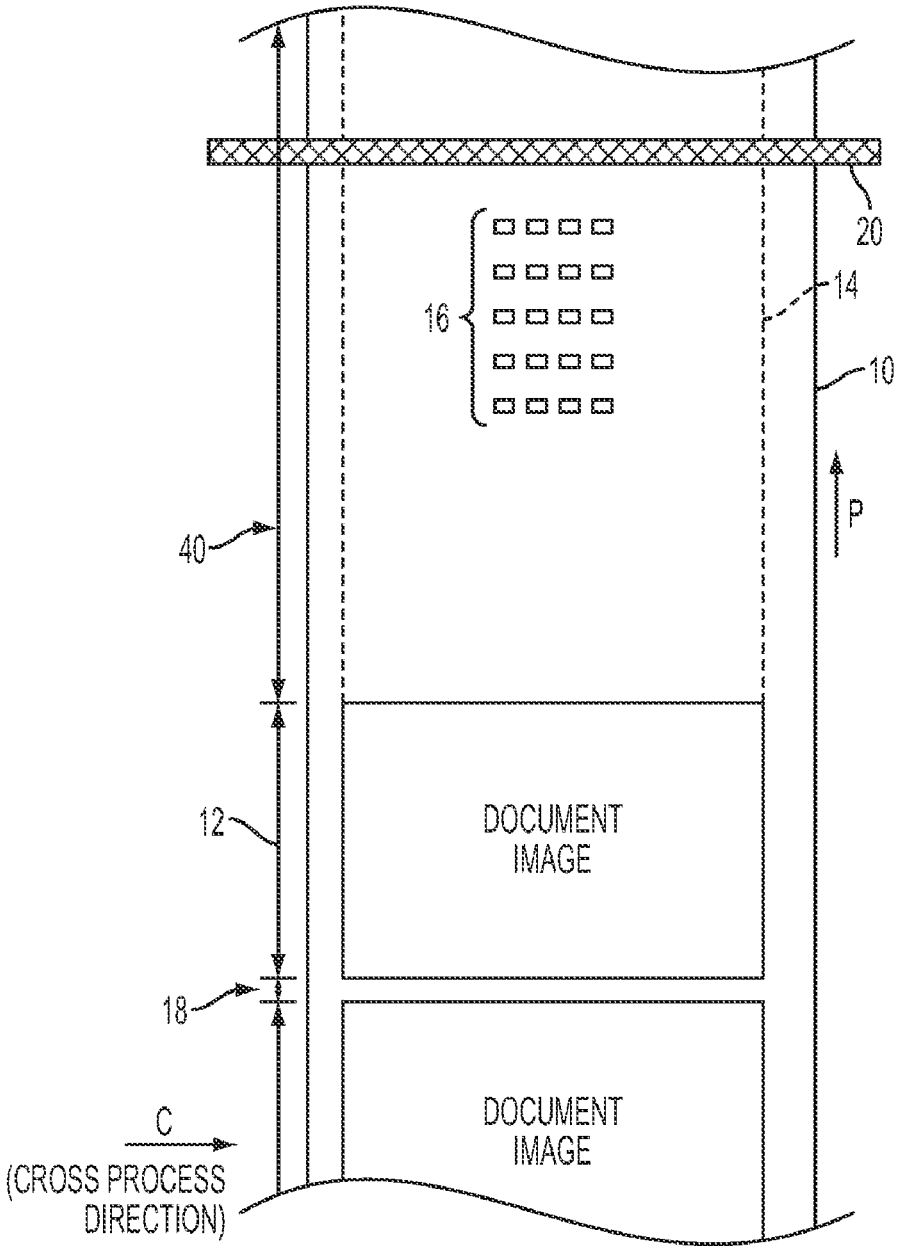
FIG. 3 illustrates a top plan view of a continuous paper web including document image areas and test images before the document image areas in accordance with an embodiment of the disclosure.

In another embodiment, the selected profile comprises a time being when the printing system cycles up to print the one or more print jobs and a location being before the plurality of jets output document images. In this embodiment, for example, the printing system fires all of the jets within each print head. When this profile is selected, test images are no longer printed within the IDZ region between the output document images of the job. Rather, test images are printed during cycling up for a print job, as illustrated in FIG. 3. In an embodiment, "cycling up" of the print system refers to when a machine or an apparatus is initially powered. Typically, in this case, when the machine powers up, the paper web is moved and a first few feet of paper that is moved in the machine are wasted. Thus, in this embodiment, as shown in FIG. 3, the jets would fire and print the necessary test images 16 on the paper 10 in area 40 before or at the beginning of the job or cycle. The test images 16 may be provided within in imageable area 14 before document images 12 are printed, for example (i.e., the wasted paper).

In another embodiment, "cycling up" of the print system refers to when a machine or apparatus powers out of a sleep or standby mode, i.e., when the machine is warming up and getting ready to print a job. Similarly, test images 16 could be printed in an area 40 as shown in FIG. 3. In an embodiment, the selected profile comprises a time being when the printing system exits a standby mode (sometimes also referred to as a sleep mode) and a location being on the imageable surface before the plurality of jets output document images for the one or more print jobs.

Figure 4:
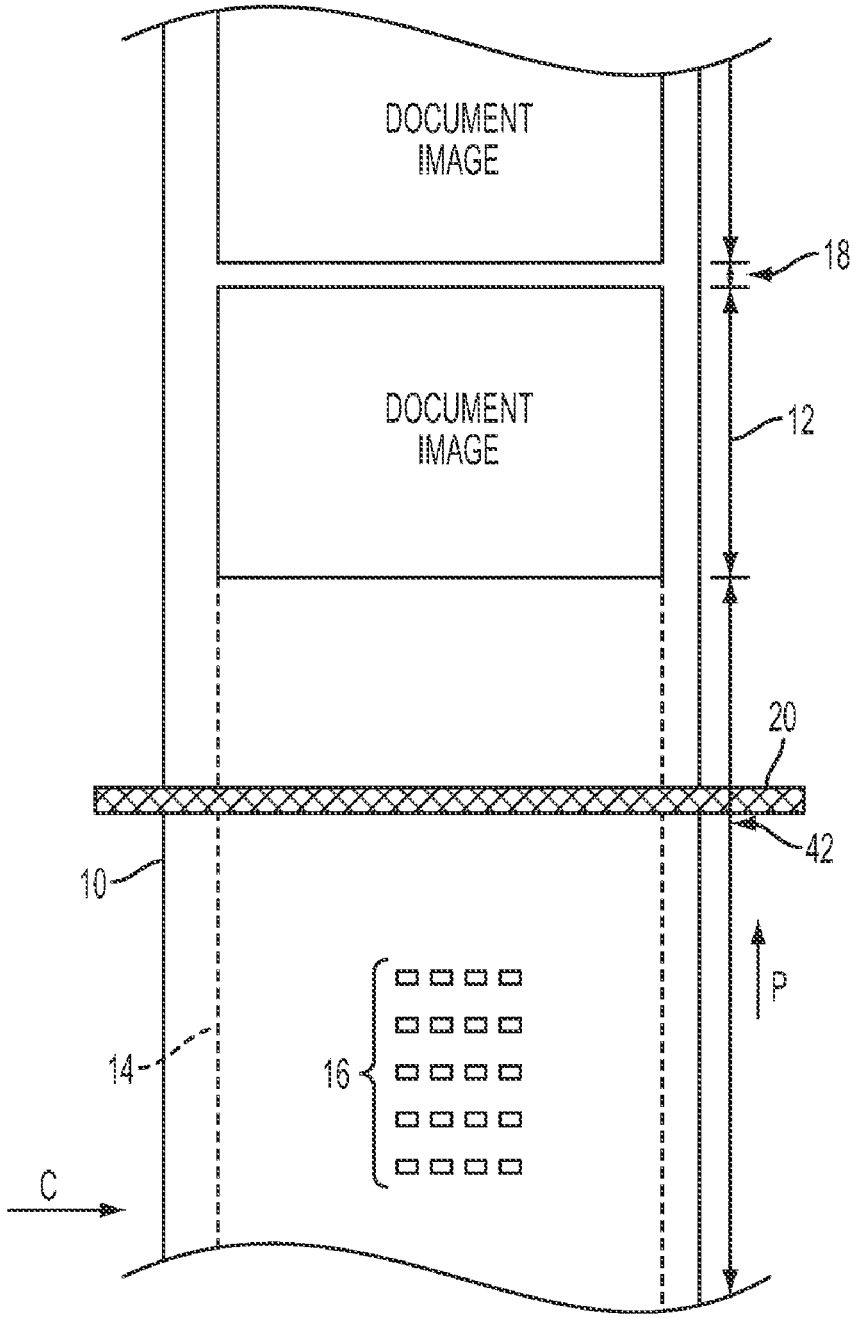
FIG. 4 illustrates a top plan view of a continuous paper web including document image areas and test images after the document image areas in accordance with an embodiment of the disclosure.

In yet another embodiment, the selected profile comprises a time being when the printing system cycles down after printing the one or more print jobs and a location being after the plurality of jets output document images. In this embodiment, for example, the printing system fires all of the jets within each print head. Like the above described embodiment, when this profile is selected, test images are no longer printed within the IDZ region between the output document images of the job. Rather, test images are printed during cycling down of a print job, as illustrated in FIG. 4. "Cycling down" of the print system refers to when a machine or apparatus is powering down. For example, powering down may occur when a print job completes or when the system goes into a sleep or standby mode (e.g., after not printing for a predetermined period of time). In this case, when the machine powers down, there are wasted feet of paper at an end of the job or cycle. Thus, in this embodiment, as shown in FIG. 4, the jets would fire and print the necessary images 16 on the paper 10 in an area 42 after or at the end of the job or cycle. The test images 16 may be provided within in imageable area 14 after document images 12 are printed, for example (i.e., the wasted paper).

In yet another embodiment, the selected profile comprises a time being when a fault in the printing system is detected and a location being at a location corresponding to the time of the detected fault. That is, when a particular condition is detected, missing jet detection (i.e., printing and analyzing test images) is activated or implemented. In an embodiment, a profile may implement or bypass jet detection based on a determined type of fault. If a specific fault is detected or determined, detection may be turned on (or off). For example, the customer or user can specify which faults in the system require missing jet detection to automatically turn on, and/or which to bypass or ignore. In an embodiment, a detection of one or more faults includes detecting faults related to image quality (i.e., degradation in image quality). Examples of image quality faults or degradation include lighter and/or darker images, low resolution, decreased sharpness, and streaks or shadows in output images. In another embodiment, a detection of faults includes detecting faults related to print heads. For example, a determination may be made that one or more jets are not usable due to clogging. The predetermined conditions of the profile may determine that this type of fault detection should be bypassed and that missing jet detection should not occur.

In an embodiment, a user interface and/or a screen may be used to indicate one or more faults that are detected. For example, a visual indication may be provided on the screen. In another embodiment, one or more indicator lights may be used. In yet another embodiment, an indication may be made remotely via a processor and a network connection (e.g., the processor of the system is programmed to send an e-mail or similar alert to a specified user). Additionally and/or alternatively, an audible alarm may sound.

Figure 5:
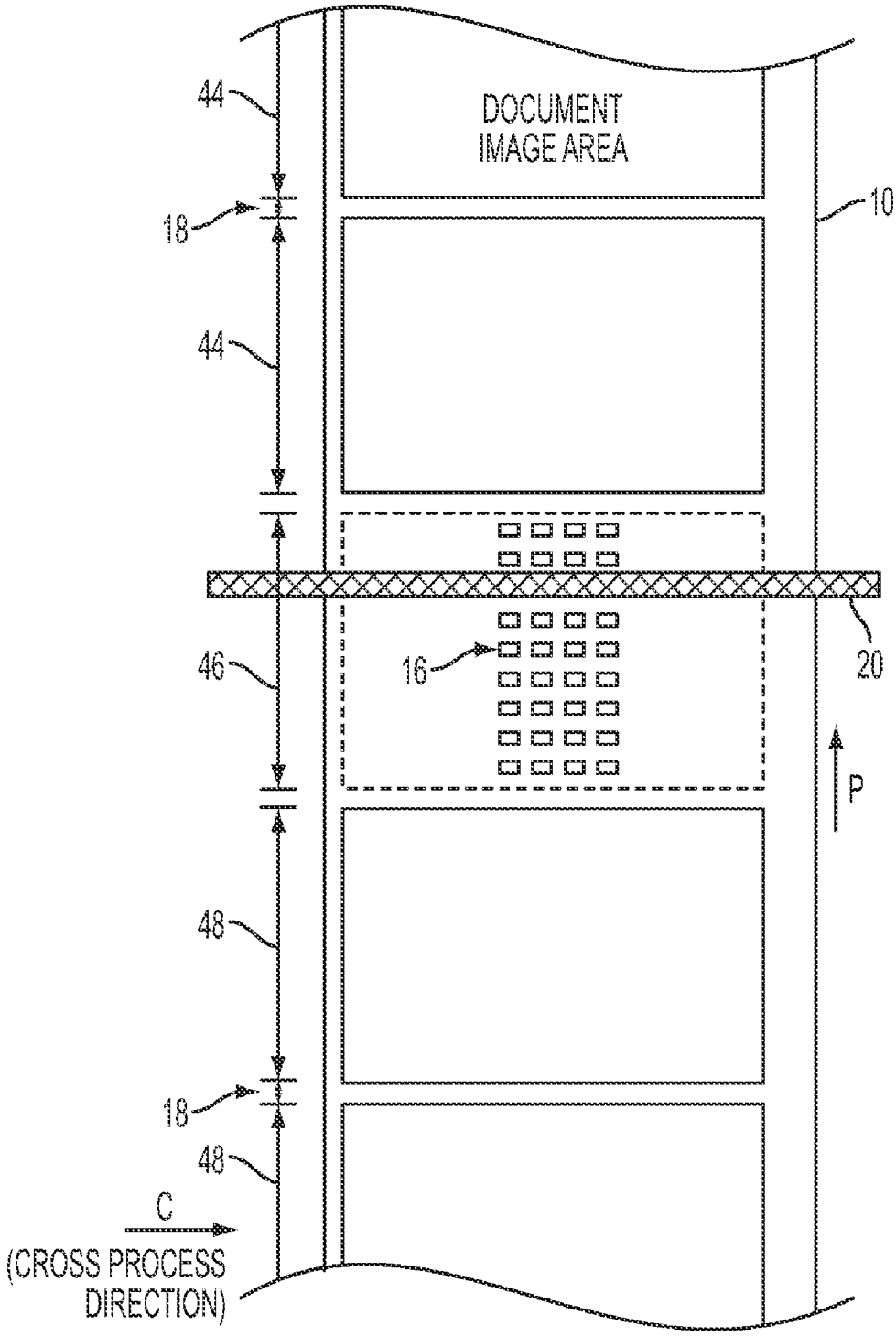
FIG. 5 illustrates a top plan view of a continuous paper web including document image areas and test images on areas provided between print jobs in accordance with an embodiment of the disclosure.

In another embodiment, the selected profile comprises a time being between the one or more print jobs in a queue of the printing system and the location being on one or more blank test sheets or areas provided between the print jobs. FIG. 5 illustrates such an exemplary embodiment. For example, after output document images 44 for a first print job are finished printing on the web 10, the printing system will automatically insert a blank test area 46 before document output images of a second print job 48, and fire all jets on this blank test area 46 to output test images 16. In an embodiment, the blank test area comprises a size may be similar in size as a sheet, e.g., so that a blank sheet may be cut and output between first and second jobs 44 and 48. This embodiment allows for the testing and sensing of the jets during long print runs comprising multiple jobs or multiple sets within a job. A user can then discard the essentially blank sheet (only having, at most, test images thereon) during or after finishing.

Figure 6:
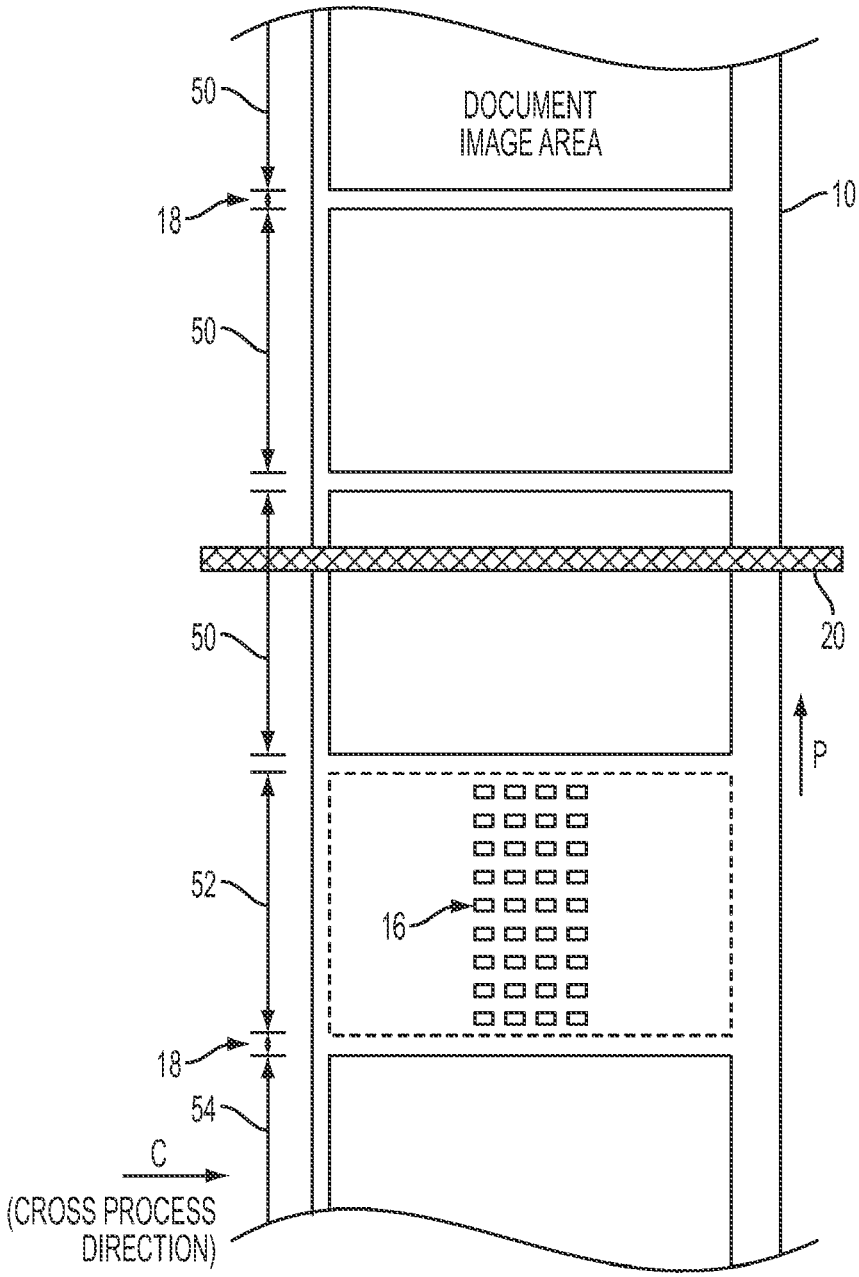
FIG. 6 illustrates a top plan view of a continuous paper web including document image areas and test images after a preselected number of pages in accordance with an embodiment of the disclosure.

In another embodiment, the selected profile comprises a time being after a preselected number of pages in the one or more print jobs and a location being on one or more blank test sheets provided after the selected number of pages. In this embodiment, for example, the printing system will automatically insert a blank test area or sheet after "X" number of pages in the job, and fire all of the jets within each print head on the blank test area to output and sense test images. For example, in an embodiment, a user may input via a user interface a total number of pages that are provided in each print job. The processor and/or controller receive the total number of pages. In an embodiment, the preselected number of pages or "X" number of pages may be a portion of the total number of pages in the one or more print jobs. FIG. 6 illustrates such an exemplary embodiment. If X equals 3, i.e., after a first three document output pages 50 are printed, the printing system will automatically insert a blank test area 52 before printing document output images of a second set of three pages 52, and fire all jets on this blank test area 52 to output test images 16. In an embodiment, the blank test area comprises a size may be similar in size as a sheet, e.g., so that a blank sheet may be cut and output between first and second sets 50 and 52. In an embodiment, the first and second sets 50 and 52 may be part of one print job (e.g., each are pages of a single document). In another embodiment, the first and second sets may be separate print jobs or documents.

In an embodiment, the preselected number of pages may be received via input on the user interface. For example, a customer could select through the user interface how many pages occur between insertion of blank test sheet or page for jet firing and detection. This embodiment allows for testing and sensing of the jets during long jobs with only one set. A user can then discard the essentially blank sheet (only having, at most, test images thereon) during or after finishing.

In yet another embodiment, the selected profile comprises a time being after a preselected number of pages, as shown in FIG. 6, but the location is within the IDZ region 18 (i.e., no blank test areas or sheets are added after the preselected number of pages). For example, test images 16 may be printed and sensed in an IDZ region 18 after "X" number of pages are printed.

In another embodiment, the selected profile comprises a time being after paper is loaded into the printing system and a location being before the plurality of jets output document images. For example, when a new paper roll is loaded into the machine, missing jet detection may be turned on/off automatically (e.g., turned off when machine is open for loading, turned on when the system sets itself up for the new media specifications).

In an embodiment, a time and a location may be after a predetermined number of print jobs, e.g., after every tenth (10th) job, missing jet detection is turned on and implemented (i.e., test images are printed and analyzed). In an embodiment, a location may be after a predetermined number of feet of an imageable surface or paper web, e.g., after ten thousand feet of web, test images are printed and analyzed.

In yet another embodiment, missing jet detection may be turned on/off when entering or exiting diagnostics. Diagnostics can include, but are not limited to, any diagnostics routine which can print images as part of the routine, such as print test patterns, image on paper registration setup, print head replacement routines, print head maintenance routines, etc., as well as general diagnostics such read/write memory problems, component control, and the like.

Although the above-described embodiments describe several profiles or scenarios where jet detection may be turned on or turned off during times and locations in a cycle of a print system, it is to be understood that these embodiments are not limiting, and that other times and locations for outputting and sensing test images are within the scope of this disclosure. Specifically, any time and location for altering a time and/or a location for outputting and/or sensing test images or patterns may be incorporated within this disclosure.

Moreover, the predetermined conditions of any of the profiles need not be limited by a particular time or period in a job or the machine. For example, in an embodiment, a condition could include other features related to a print job, such as a type of image being printed, use of particular colors for output, jet thresholds (as previously noted), and/or other conditions that may require output and analysis of test images for improved output images.

Additionally, it is to be understood that jet detection may be temporarily turned off until a condition or a profile is met/matched.

Figure 7:
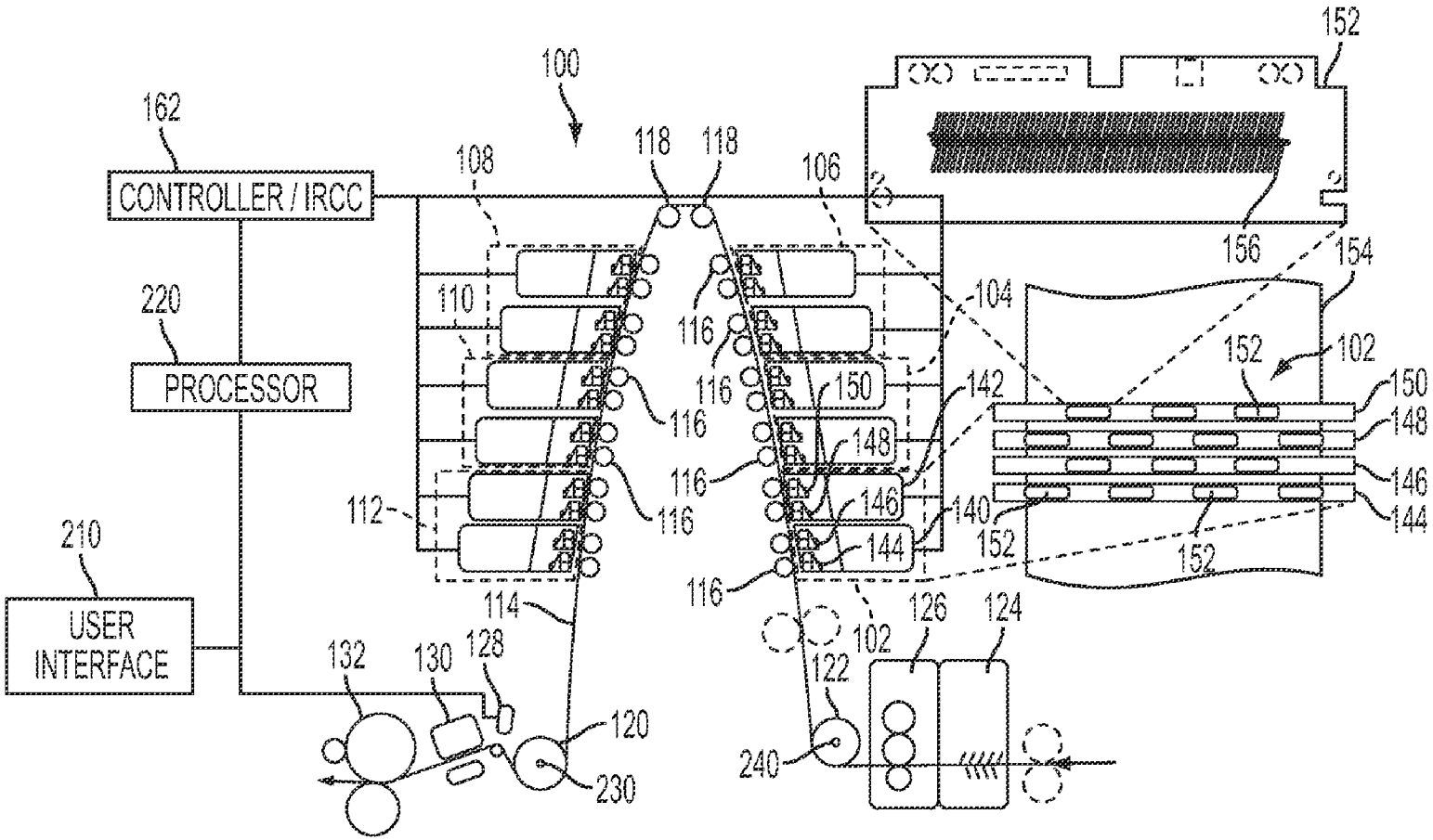
FIG. 7 illustrates a schematic view of an exemplary continuous web printing system with print modules along with expanded schematic views showing print heads positioned within print sub-modules and nozzles within a print head.

As previously mentioned, the plurality of profiles described above may be accessed and selected by a user or a customer through, for example, control system software, on a User Interface (UI) associated with the printing system. FIG. 7 illustrates a user interface module 210 associated with printing system 100. The UI allows users to select when and where they want missing jet detection images to be printed and not printed (and sensed, and not sensed). Users can have control of conditions when missing jet detection (and the necessary images that need to be printed) happens in the machine. When a user selects a profile, parameters are created based on the user selections and sent to the controller (software) to enact actions within the machine at specified time(s) and location (s). This provides a parameterized control of missing jet detection within the system by the user.

The user interface module 210 is configured to generate a graphical user interface (GUI) on a display device and to control the various display and input/output (I/O) features of the application which provides the plurality of profiles. In one implementation, it may provide one more "windows" or panes for displaying information to the user.

In an embodiment, the UI 210 is provided on the printing system, i.e., on the machine. In another embodiment, the user interface 210 is provided in a remote location in relation to the printing system 100, and is remotely connected to the printing system via a network. The display device may include a cathode ray tube (CRT), liquid crystal display (LCD), plasma, or other display devices.

Moreover, the user interface module 210 allows the user to interact with the system. For example, the user interface module 210 may permit use and operation of one more of: a keyboard, keypad, touch-screen, mouse, joystick, light pen, or other peripheral devices for receiving inputs from a user. Similarly, the application may output information and data to the user, for example, via a printer or other peripheral device (e.g., external storage device or networked devices).

The user interface module 210 may interact with a computer's operating system and/or one or more other software applications. In one implementation, the selections may be provided in an application comprising a stand-alone software application running on a computer, printing system, or other machine (e.g. via a connection). Alternatively, a server (not shown) may host the application, which may, in some implementations require a user to access the server over a network to use the application. In some implementations, a user may download the application from a server, with program updates made available (over the network or the Internet) as needed, or on a predetermined, regularly-scheduled basis. The application may be operated in a Microsoft Windows® operating environment. However, other operating systems and environments (e.g., UNIX, Linux, and proprietary systems, such as Apple Mac OS X) are also envisioned.

Referring now more particularly to the drawings, FIG. 7 illustrates an exemplary continuous web printer system 100 used in an embodiment of this disclosure. Generally, such continuous web printer systems are known in the art, and, therefore, not all of its features are described herein. For example, U.S. patent application Ser. No. 12/755,117, filed Apr. 6, 2010 and assigned to the same assignee (Xerox Corporation), which is hereby incorporated by reference in its entirety, describes a continuous web printer system that may be used in accordance with this disclosure. However, the incorporated system and/or the illustrated continuous web printer system 100 of FIG. 7 and its selectively described features (below) are not meant to be limiting. For example, the illustrated printer system 100 is described as having a single print engine. However, in an embodiment, system 100 could have two print engines.

Generally, the printing system 100 comprises a processor 220 for processing documents containing image data, a controller 162 for controlling elements of the printing system, a plurality of jets 156 in print heads 152 for outputting test images and document images, and a jet detection device 128 comprising at least one or more sensors for reading the output test images to detect faulty jets, In the illustrated embodiment of FIG. 7, the continuous web printing system 100 includes a print engine, a linear array sensor or an image sensor 128, a processor 220 and a controller 162. The continuous web printer system 100 also includes a web supply and handling system that is configured to supply a very long (i.e., substantially continuous) web 154 of "substrate" or "media" (e.g., paper, plastic or other printable material) from a spool (not shown). In another embodiment, the web 154 is in the form of an extensible image receiving member, such as a belt, which defines an image receiving surface that is driven in a process direction between print modules of the print engine. The web 154 may be unwound as needed, and propelled by a variety of motors, not shown. The web supply and handling system is capable of transporting the web 154 at a plurality of different speeds. A set of rolls are configured to control the tension of the unwinding web as the web moves through the path 114.

The print engine of the continuous web printing system 100 includes a series of print (or color) modules 102, 104, 106, 108, 110, and 112, each print module 102, 104, 106, 108, 110, and 112 effectively extending across the width of the web 154 in the cross-process direction. The print engine is configured to print a test image (or test pattern) on a template media. As shown in FIG. 1, the print modules 102, 104, 106, 108, 110, and 112 may be positioned sequentially along the in-track axis of a process path 114 defined in part by rolls 116. The process path 114 is further defined by upper rolls 118, leveler roll 120 and pre-heater roll 122. A brush cleaner 124 and a contact roll 126 are located at one end of the process path 114. The image sensor 128, a heater 130 and a spreader 132 are located at the opposite end of the process path 114.

Each print module 102, 104, 106, 108, 110, and 112 is configured to provide an ink of a different color. Six print modules are shown in FIG. 1 although more or fewer print modules may be used. Each print module may include print sub modules 140 and 142, which each include two print units 144, 146, 148 and 150. The print units 144, 146, 148, and 150 each include print heads 152. The use of multiple print heads 152 allows for an image to be printed on the web 154, which is much wider than an individual print head 152.

Figure 8:
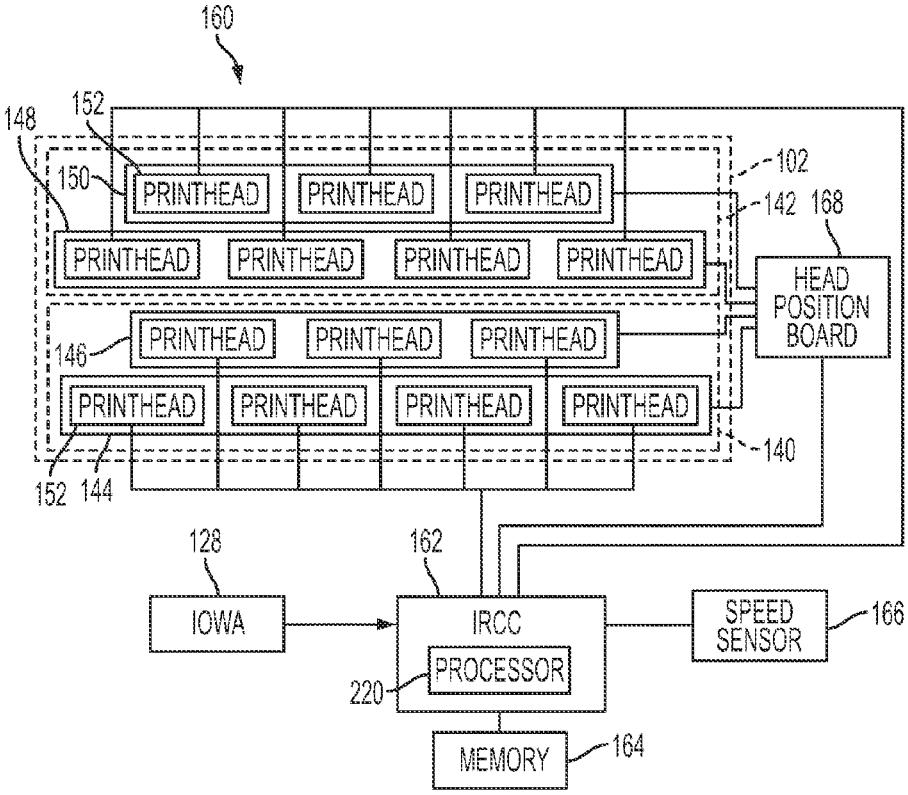
FIG. 8 illustrates a schematic of a control system that may be used with the system of FIG. 7.

Each of the print heads 152 includes rows of jet nozzles 156. Each of the jet nozzles 156 are individually controlled to jet a spot of ink on the web 154. As shown in FIGS. 7 and 8, the multiple print heads are distributed in a print zone over a long span of the web 154. The position of the print heads is determined using a detection device, such as Integrated Registration and Color Control (IRCC) technology. This detection device includes the image sensor 128 and typically a board or controller 162 to adjust process (y) and cross-process (x) direction distances between print heads, for example. The controller 162 is also configured to control output and sensing of test images in the system. In an embodiment, the controller 162 may include the processor 220. The controller 162 and/or processor 220 are in communication with the user interface module 210.

In an embodiment, alignment of the print modules 102, 104, 106, 108, 110, and 112 with the process path 114 is controlled by a control system 160 shown in FIG. 8 (only print module 102 is shown in FIG. 3). The control system 160 may be used with the system of FIG. 7 to control generation and detection of test images (or test patterns) and to control the process position and the cross-process position of print heads or jets, i.e., for jet detection, as described above. Such jet detection may include determining that a jet nozzle 156 is not working, and the controller may instruct other nozzles to generate test images, as needed.

In an embodiment, the image sensor 128 of FIG. 7 is a full width image linear array sensor, which monitors the ink on the web 154 as the web 154 passes under the image sensor 128. The array may comprise a multi-chip configuration. The sensors may be positioned adjacent the web 154 to capture reflected light and the like to read in a cross-process direction C as the web 154 moves in a processing direction P. As shown, the sensor 128 is positioned along the process path 114 of the web 154. When there is ink on the web 154, the light reflection off of the web 154 is low and when there is no ink on the web 154, the amount of reflected light is high. When a test pattern of ink is printed by one or more of the print heads 152 under the control of the control board 162, the image sensor 128 may be used to sense the printed test image and provide a sensor output to the processor 220. An exemplary full width array sensor that is used in a print head registration correction system to achieve the image registration in the direct marking continuous web printers is described in U.S. Patent Application Publication No. 2008/0062219, hereby incorporated by reference in its entirety, and hence will not be explained in detail here.

In one embodiment, the processor 220 can comprise either one or a plurality of processors therein. Thus, the term "processor" as used herein broadly refers to a single processor or multiple processors. In one embodiment, the processor 220 can be a part of or forming a computer system. In one embodiment, the processor 220 can be a part of the control board 162 (see FIG. 8). In an embodiment, the processor 220 of the system 160 may be configured to receive, determine, and implement the selected profile for jet detection, as described in method 22 of FIG. 2.

Other embodiments include incorporating the above method 22 and jet detection profiles into a set of computer executable instructions readable by a computer and stored on a data carrier or otherwise a computer readable medium, such that the method 22 of FIG. 2 is automated. In a possible embodiment, the method may be incorporated into an operative set of processor executable instructions configured for execution by at least one processor (e.g., processor 220). FIG. 2 shows a flow chart of such computer readable instructions. For example, in some embodiments, memory or storage of an output device carrying instructions and jet detection profiles is configured such that when the executable instructions are executed by a computer or processor, they cause a computer or processor to automatically perform a method for implementing a selected profile and outputting and sensing test images. Such instructions may be contained in a memory of a printing system, for example. In another embodiment, the method 22 and its jet detection profiles may be provided in the form of a software program that may be added or uploaded to new or existing systems. In alternative embodiments, hardwired circuitry may be used in place of or in combination with software instructions to implement the disclosure. Thus, embodiments of this disclosure are not limited to any specific combination of hardware circuitry and software. Any type of computer program product or medium may be used for providing instructions, storing data, message packets, or other machine readable information associated with the method 22 and its jet detection profiles. The computer readable medium, for example, may include non-volatile memory, such as a floppy, ROM, flash memory, disk memory, CD-ROM, and other permanent storage devices useful, for example, for transporting information, such as data and computer instructions. In any case, the medium or product should not be limiting.

As previously noted, the herein disclosed method offers a user or a customer a selectable choice of a number of profiles comprising at least when (time) and where (location) to place the output test image (or test pattern) that is used during detection of missing jets via a jet detection device (instead of just turning it entirely on or entirely off as in known systems). This disclosure also reduces or prevents problems that may occur when a user is unable to chip out test images in output documents (e.g., due to existing finishing capabilities in their machine). Furthermore, this disclosure substantially eliminates a need for a user to replace existing finishing equipment with new equipment that can handle chip out, or a need to buy a chip out capability for their existing cutter/stacker finishing equipment. It allows a user to implement different jet detection profiles, regardless of the finishing equipment they own.

Additionally, in some embodiments, paper which is typically wasted during printing is utilized for printing and sensing test images. Thus, no additional paper or media is wasted for missing jet detection, nor are pages of the output document marked.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that various of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. A method for implementing a selected profile for jet detection in a printing system, the printing system comprising a processor for processing documents containing image data, a plurality of jets for outputting test images and document images onto an imageable surface, and a jet detection device comprising at least one or more sensors for reading the output test images on the imageable surface to detect faulty jets, the method comprising the following acts implemented by the processor:

providing a plurality of predetermined profiles for the jet detection device to a user interface associated with the printing system, each profile comprising at least a time relating to a print cycle and a location for printing output test images on the imageable surface using one or more of the plurality of jets and sensing using the at least one or more sensors;

receiving a selected profile of the plurality of profiles selected for jet detection;

determining at least the time and the location for printing output test images on the imageable surface using the received selected profile, and implementing the received selected profile for one or more print jobs of the printing system including printing output test images on the imageable surface at the time and location of the selected profile, and wherein upon receipt of another selection, the processor is configured to receive, determine, and implement another selected profile of the plurality of profiles comprising at least a time relating to a print cycle and a location for printing output test images on the imageable surface using one or more of the plurality of jets and sensing using the at least one or more sensors that is different from the received selected profile.

2. The method of claim 1, wherein the selected profile comprises the time as being one selected from the group consisting of: a time between outputting document images of the one or more print jobs onto the imageable surface; when the printing system cycles up to print the one or more print jobs; when the printing system cycles down after printing the one or more print jobs; when a fault in the printing system is detected; a time between outputting the one or more print jobs in a queue of the printing system; after a preselected number of pages in the one or more print jobs are output; after paper is loaded into the printing system, and when the printing system exits a standby mode.

3. The method of claim 1, wherein the selected profile comprises the location as being one selected from the group consisting of: within an inter-document zone between the document images on the imageable surface; on the imageable surface before the plurality of jets output the document images for the one or more print jobs; on the imageable surface after the plurality of jets output the document images for the one or more print jobs; on the imageable surface at a predetermined location at a time of a detected fault; on one or more blank test areas provided between the one or more print jobs; and on one or more blank test areas provided after a selected number of output document images or pages.

4. The method of claim 1, wherein the selected profile comprises the time being a time between outputting document images of the one or more print jobs onto the imageable surface and the location being within one or more inter-document zones between the document images on the imageable surface.

5. The method of claim 1, wherein the selected profile comprises the time being when the printing system cycles up to print the one or more print jobs and the location being on the imageable surface before the plurality of jets output document images for the one or more print jobs.

6. The method of claim 1, wherein the selected profile comprises the time being when the printing system exits a standby mode and the location being on the imageable surface before the plurality of jets output document images for the one or more print jobs.

7. The method of claim 1, wherein the selected profile comprises the time being when the printing system cycles down after printing the one or more print jobs and the location being on the imageable surface after the plurality of jets output document images for the one or more print jobs.

8. The method of claim 1, wherein the selected profile comprises the time being when a fault in the printing system is detected and the location being on the imageable surface at a predetermination location at a time of a detected fault.

9. The method of claim 1, wherein the selected profile comprises the time being a time between outputting the one or more print jobs in a queue of the printing system and the location being on one or more blank test areas provided between the print jobs.

10. The method of claim 1, wherein the selected profile comprises the time being after a preselected number of document images or pages in the one or more print jobs are output and the location being on one or more blank test areas provided after the selected number of output document images or pages.

11. The method of claim 10, further comprising receiving a total number of pages in the one or more print jobs via the provided user interface.

12. The method of claim 11, wherein the preselected number of pages in the one or more print jobs is a portion of the total number of pages in the one or more print jobs.

13. The method of claim 10, wherein the preselected number of pages in the one or more print jobs is a portion of the total number of pages in the print job.

14. The method of claim 1, wherein the selected profile comprises the time being after paper is loaded into the printing system and the location being on the imageable surface before the plurality of jets output document images.

15. The method according to claim 1, further comprising:

receiving the another selected profile of the plurality of profiles selected for jet detection, the another selected profile comprising at least a time relating to a print cycle and a location for printing output test images on the imageable surface using one or more of the plurality of jets and sensing using the at least one or more sensors that is different from the received selected profile;

determining at least the time and the location for printing output test images on the imageable surface using the received another selected profile, and implementing the received another selected profile for one or more print jobs of the printing system including printing output test images on the imageable surface at the time and location of the received another selected profile.

16. A user interface associated with a printing system, the printing system comprising a processor for processing documents containing image data; a plurality of jets for outputting test images and document images onto an imageable surface; and a jet detection device comprising at least one or more sensors for reading the output test images to detect faulty jets, wherein the user interface provides a plurality of predetermined profiles for the jet detection device for selection, each profile comprising at least a time relating to a print cycle and a location for printing output test images using one or more of the plurality of jets, and wherein the processor is configured to implement the selected profile for one or more print jobs of the printing system including printing output test images on the imageable surface at the time and location of the selected profile, and wherein upon receipt of another selection, the processor is configured to implement another selected profile of the plurality of predetermined profiles comprising at least a time relating to a print cycle and a location for printing output test images on the imageable surface using one or more of the plurality of jets and sensing using the at least one or more sensors that is different from the selected profile.

17. The user interface of claim 16, provided on the printing system.

18. The user interface of claim 16, wherein the user interface is provided in a remote location in relation to the printing system and is remotely connected to the printing system via a network.

19. The user interface of claim 16, wherein the selected profile comprises the time as being one selected from the group consisting of: a time between outputting document images of the one or more print jobs onto the imageable surface; when the printing system cycles up to print the one or more print jobs; when the printing system cycles down after printing the one or more print jobs; when a fault in the printing system is detected; a time between outputting the one or more print jobs in a queue of the printing system; after a preselected number of pages in the one or more print jobs are output; after paper is loaded into the printing system, and when the printing system exits a standby mode.

20. The user interface of claim 16, wherein the selected profile comprises the location as being one selected from the group consisting of: within an inter-document zone between the document images on the imageable surface; on the imageable surface before the plurality of jets output the document images for the one or more print jobs; on the imageable surface after the plurality of jets output the document images for the one or more print jobs; on the imageable surface that is adjacent to the plurality of jets at a time of a detected fault; on one or more blank test areas provided between the one or more print jobs; on one or more blank test areas provided after a selected number of output document images or pages; and on the imageable surface before the plurality of jets output document images.

21. The user interface of claim 16, wherein the time is between document images of the one or more print jobs onto the imageable surface and the location is within one or more inter-document zones between the document images on the imageable surface.

22. The user interface of claim 16, wherein the time is when the printing system cycles up to print the one or more print jobs and the location is on the imageable surface before the plurality of jets output document images for the one or more print jobs.

23. The user interface of claim 16, wherein the time is when the printing system exits a standby mode and the location is on the imageable surface before the plurality of jets output document images for the one or more print jobs.

24. The user interface of claim 16, wherein the time is when the printing system cycles down after printing the one or more print jobs and the location is on the imageable surface after the plurality of jets output document images for the one or more print jobs.

25. The user interface of claim 16, wherein the time is when a fault in the printing system is detected and the location is on the imageable surface at a predetermination location at a time of a detected fault.

26. The user interface of claim 16, wherein the time is a time between outputting the one or more print jobs in a queue of the printing system and the location is on one or more blank test areas provided between the print jobs.

27. The user interface of claim 16, wherein the time is after a preselected number of pages in the one or more print jobs and the location is on one or more blank test sheets provided after the selected number of pages.

28. The user interface of claim 26, wherein the preselected number of pages in the one or more print job is a portion of the total number of pages in the print job.

29. The user interface of claim 16, wherein the time is after paper is loaded into the printing system and the location is on the imageable surface before the plurality of jets output document images.

* * * * *